US005688040A

United States Patent [19]

Klees

[11] Patent Number: 5,688,040

[45] Date of Patent: Nov. 18, 1997

[54] PORTABLE, TUB CANDLE LANTERN

[76] Inventor: Garry W. Klees, 7515 SE. 76th St., Mercer Island, Wash. 98040

[21] Appl. No.: 587,922

[22] Filed: Jan. 17, 1996

[51] Int. Cl.[6] ..... F21L 19/00

[52] U.S. Cl. ..... 362/163; 362/172; 362/180; 362/181; 362/373

[58] Field of Search ..... 362/161, 163, 362/172, 181, 373, 810, 96, 171, 178, 180, 294

[56] References Cited

U.S. PATENT DOCUMENTS

| | | | |
|---|---|---|---|
| 97,246 | 11/1869 | Thompson | 362/181 |
| 1,115,067 | 10/1914 | Gwozdziewicz et al. | 362/161 |
| 1,134,878 | 4/1915 | Laszczak | 362/161 |
| 1,255,614 | 2/1918 | Knapp | 362/163 |
| 2,254,664 | 9/1941 | Quinlan | 362/163 |
| 3,867,625 | 2/1975 | Whalen | 362/161 |
| 3,918,888 | 11/1975 | Clark et al. | 431/297 |
| 4,186,430 | 1/1980 | Britton | 362/162 |
| 4,260,365 | 4/1981 | Kayne | 431/291 |
| 4,566,055 | 1/1986 | Klees et al. | 362/162 |
| 5,012,393 | 4/1991 | Knipe et al. | 362/163 |

*Primary Examiner*—Alan Cariaso
*Attorney, Agent, or Firm*—Craine & Jackson, P.S.

[57] ABSTRACT

A portable candle lantern with safety features designed to be used with a tub candle. The candle lantern includes an upper cover that selectively attaches to a lower base. The lower base has a plurality of feet with enable it to be supported in an elevated position on a support surface. Located inside the lower base is a candle holding assembly which removably holds a tub candle in an elevated, longitudinally aligned position therein. Formed inside the lower base is a centrally located, longitudinally aligned, upward extending, air delivery tube which delivers cool air directly against the sides of the tub candle and the candle holding assembly. By delivering cool air in this manner, the temperature inside the candle lantern is reduced thereby preventing a "flash" condition from occurring. Also, a collection cavity is formed between the air delivery tube and the sides of the lower base in which spilled wax from the tub candle is collected.

8 Claims, 2 Drawing Sheets

PORTABLE, TUB CANDLE LANTERN

BACKGROUND OF THE INVENTION

1. Field of the Invention

This invention relates to candle-type illumination devices and, more particularly, to portable candle lanterns.

2. Description of the Related Art

Portable candle lanterns are illumination devices which contain a candle housed inside a candle holder assembly. Conventional candle lanterns are described in U.S. Pat. Nos. 4,566,065, 4,260,365, 4,186,430, and 3,867,625.

Typically, candle lanterns have small ventilation holes manufactured on the sides of their bases which enable combustion air for the candle flame to enter. Unfortunately, the amount of combustion air which enters the candle lantern is inadequate for cooling various structural components used therein.

Some candle lanterns are designed to be used with a tub candle comprised of a small metal tub filled with wax which surrounds a wick. Tub candles typically burn between three to four hours depending on the diameter and length of the wick. One drawback with tub candles is that their metal tubs may become excessively hot during use. This excessive heat can cause a flash condition which can not only damage the candle lantern's structural components, but also damage the surrounding surfaces upon with the candle lantern is placed. In addition, this excessive heat can prevent safe handling.

Another drawback with existing candle lanterns designed to be used with tub candles is that no attachment means is provided for securely holding the tub candle inside the candle lantern. Typically, the tub candle is unattached and placed directly on the inside surface of the candle lantern's lower base. During transportation, the tub candle can move around and tip over causing damaging to the candle lantern's structural components or possible burning the user. To prevent such damage, the tub candles are usually removed from the candle lantern when not in use and carried separately separately.

A further drawback with candle lanterns that use tub candles is that lighting the tub candle can be awkward and inconvenient. Typically, the user must remove the candle lantern's cover and glass lens from the lower base. The tub candle is then installed on the inside surface of the lower base and ignited. The glass lens and the cover must then be re-attached to the lower base without burning the user.

A still further drawback with candle lanterns that use tub candles is that wax often spills from the metal tub during use. It is widely known that after burning a short time, wax in the metal tub begins to melt and liquefy. If the candle lantern is accidently jarred, this melted wax can easily spill out of the metal tub and drip onto the bottom of the lower base. If a large amount of wax is spilled, it can drip out through ventilation holes formed on the lower base and cause damage to surrounding surfaces. As the spilled wax accumulates on the lower base, it can also clog the ventilation holes thereby reducing the flow of combustion air into the candle lantern.

SUMMARY OF THE INVENTION

It is an object of the invention to provide an improved candle lantern designed to be used with a tub candle.

It is another object of the invention to provide such a candle lantern in which the tub candle is securely attached thereto and can be easily and conveniently lighted.

It is further object of the invention to provide such a candle lantern in which a means is provided to prevent excessive heat build up and wax spillage.

It is still further object of the invention to provide such a candle lantern that is attractive and economical to manufacture.

These and other objects of the invention are met by providing an improved candle lantern designed to be used with a tub candle. The candle lantern includes an upper cover that selectively attaches to a lower base. The lower base has an elevated candle support assembly disposed therein which securely and removably holds a tub candle in a stationary, longitudinally aligned, elevated position inside the candle lantern. By elevating and holding the tub candle in the lower base in this manner, the tub candle can be securely held in place and easily and safely ignited.

Formed inside the lower base is a centrally located, upward extending, air delivery tube designed to deliver outside cooling air directly into the lower base and against the candle support assembly and the bottom and side surfaces of the tub candle. By delivering cooling air directly against the candle support means and tub candle, sufficient amount of combustion air is always delivered to the tub candle. Also, the temperature inside the lantern candle and the candle is maintained at safe levels. The lower base has a plurality of feet formed thereon which disposes the lower base in an elevated position of a horizontal support surface. This allows the cooling air can then travel under the lower base and up through the air delivery tube. Formed between the air delivery tube and the sides of the lower base is a collection cavity which is used to collect spilled hot wax from the tub candle during use.

The lantern's upper cover is designed for easy attachment and removal from the lower base so that the tub candle may be easily replaced and lighted.

DESCRIPTION OF THE PREFERRED EMBODIMENT(S)

Figure 1:
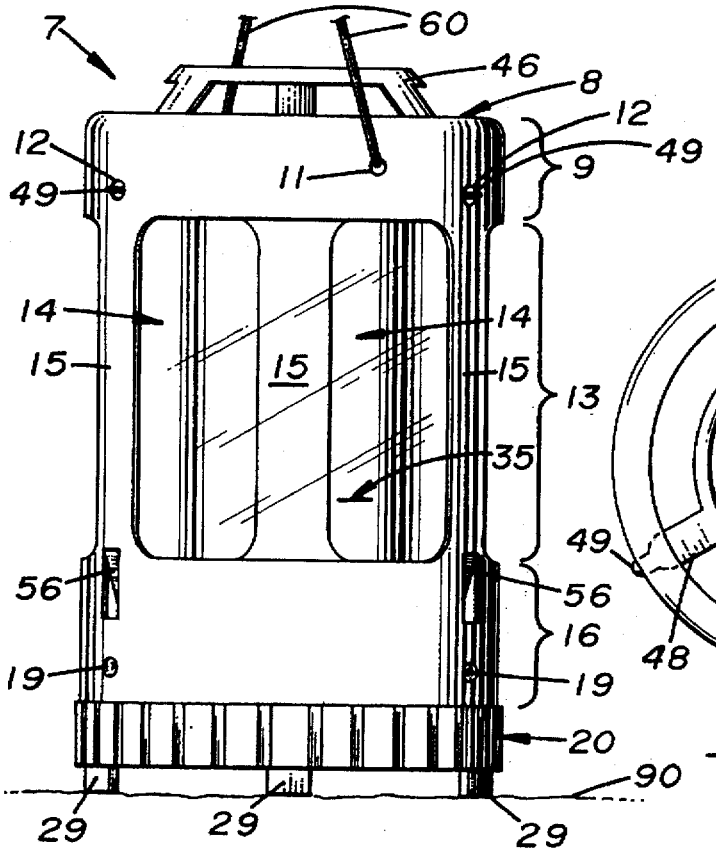
FIG. 1 is a side elevational view of the candle lantern disclosed herein.
Figure 2:
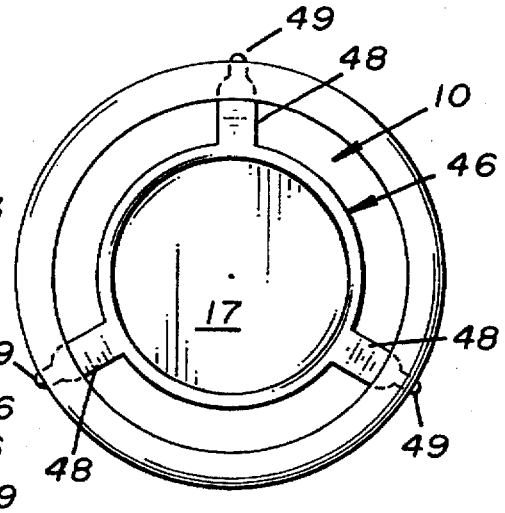
FIG. 2 is a top plan view of the candle lantern shown in FIG. 1.

Shown in the accompanying FIGS. 1–5, there is shown a portable candle lantern, generally referred to as 7 designed to be used with a tub candle 50. The candle lantern 7 includes an upper cover 8 that selectively attaches to a lower base 20 which supports the candle lantern 7 in an upright position on a support surface 90. Attached inside the lower base 20 is a candle support assembly designed to removably hold a tub candle 50 in a stationary, centrally located, longitudinally aligned, suspended position therein.

The upper cover 8 is cylindrical with an upper frame section 9, a middle frame section 13, and a lower frame section 16. Located on opposite ends of the upper cover 8 is a top opening 10 and a bottom opening 17. Disposed on the middle frame section 13 are three, radially aligned viewing openings 14 (two are shown) which are separated by three, longitudinally aligned support members 15. A cylindrical glass lens 35 is positioned inside the upper cover 8. Three notches 56 are formed on the sides of the upper cover 8 just below each support member 15 which resiliently traps and holds the glass lens 35 in position inside the upper cover 8.

Disposed over the top opening 10 of the upper cover 8 is a heat-dissipating shield 46. The heat-dissipating shield 46 includes a central portion 47 with three outward, downward radiating side webs 48. The distal tips 49 of the webs 48 extend through holes 12 manufactured on the upper region of the upper cover 8 to hold the heat-dissipating shield 46 in place thereon. When fully assembled, the webs 48 prevent upward movement of the glass lens 35 in the upper cover 8. A second pair of holes 11 is formed on the upper frame section 9 of the upper cover 8 through which the ends of an optional handle 60 may extend.

Figure 3:
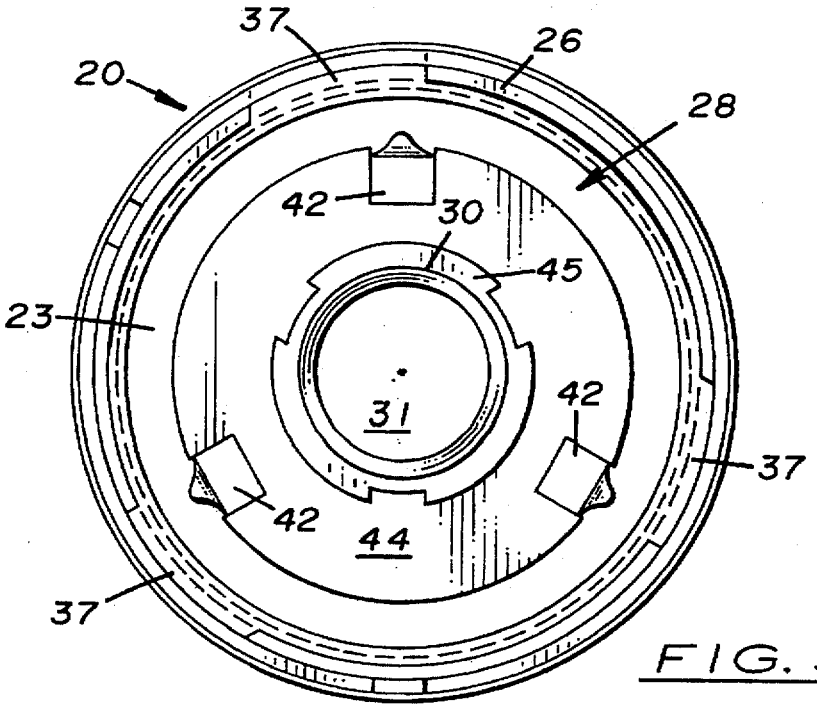
FIG. 3 is a top plan view of the lower base.
Figure 4:
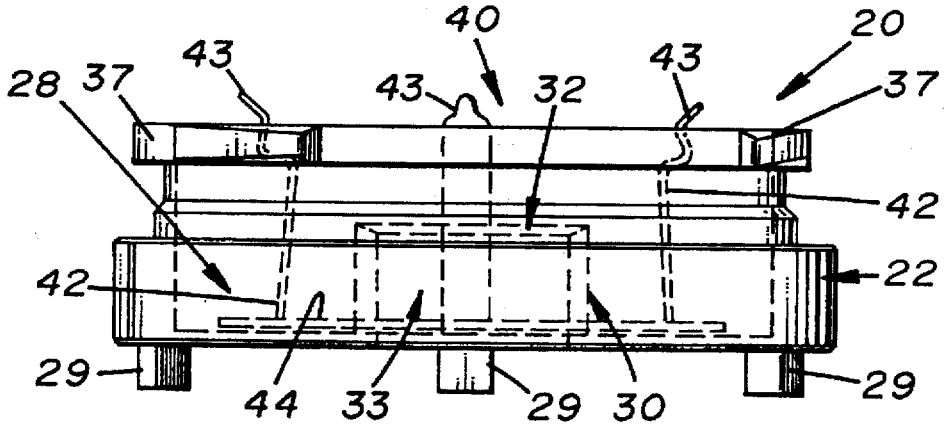
FIG. 4 is a side elevational view of the lower base shown in FIG. 3.

As shown in FIGS. 3 and 4, the lower base 20 is cylindrical with a bottom surface 23 and integrally formed, upward extending side walls 26. An upper opening 27 is formed in the lower base 20 thereby providing access to the collection cavity 28 located therein. Formed or attached to the outer surface of the bottom surface 25 of the lower base 20 is a plurality of feet 29 which support the lower base 20 in an elevated position on a support surface 90.

Integrally formed and perpendicularly aligned with the bottom surface 25 of the lower base 20 is a centrally located, longitudinally aligned air delivery tube 30. The air delivery tube 30 is designed to deliver cool combustion air inside the lower base. The air delivery tube 30 is also designed to deliver cool combustion air against the candle support assembly and the bottom and side surfaces of the tub candle 50. The air delivery tube 30 is longitudinally aligned inside the lower base 20 and has a longitudinally aligned central passageway 31 formed therein with a top and bottom openings 32, 33, respectively. The top opening 32 terminates at a point approximately one-half the height of the lower base while the bottom opening 33 terminates at the bottom surface of the lower base 20.

Disposed between the lower base 20 and the upper cover 8 is a cover attachment means which enables the upper cover 8 to be easily, selectively attached to the lower base 20. In the preferred embodiment, the cover attachment means includes at least one lip structure 37 formed on the outside surface of the lower base 20 and at least one detent structure 19 formed on the lower frame section 16 of the upper cover 8. The lip structure 37 and the detent structure 19 are radially aligned on the lower base 20 and the upper cover 8, respectively, so that when the upper cover 8 is placed over the lower base 20 and rotated, the lip structure 37 engages the detent structure 19 to selectively attach the lower base 20 to the upper cover 8. A gripping surface 22 is formed on the outer surface of the lower base 30 to improved handling.

A candle holding assembly 40 is disposed inside said lower base 20 and is designed to support a tub candle 50 in a stationary, elevated position inside the lower base and directly over the top opening 32 of the air delivery tube 30. In the preferred embodiment, the candle holding assembly 40 includes a circular plate 44 placed on the inside surface of the lower base 20. The circular plate 44 has a central opening 45 formed therein which enables the circular plate 44 to be disposed around the air delivery tube 30. A plurality of upward extending legs 42 are attached at one end to the plate 44. Formed on the distal end of each leg 42 is a clip structure 43 which engages the sides of the tub candle 50. The legs 42 are sufficient in length so that the tub candle 50 is attached to the clip structures 43, the tub candle 50 is centrally and perpendicularly aligned over the top opening 32 of the air delivery tube 30. In the preferred embodiment, three legs 42 are equally aligned and attached to the plate 44.

Figure 5:
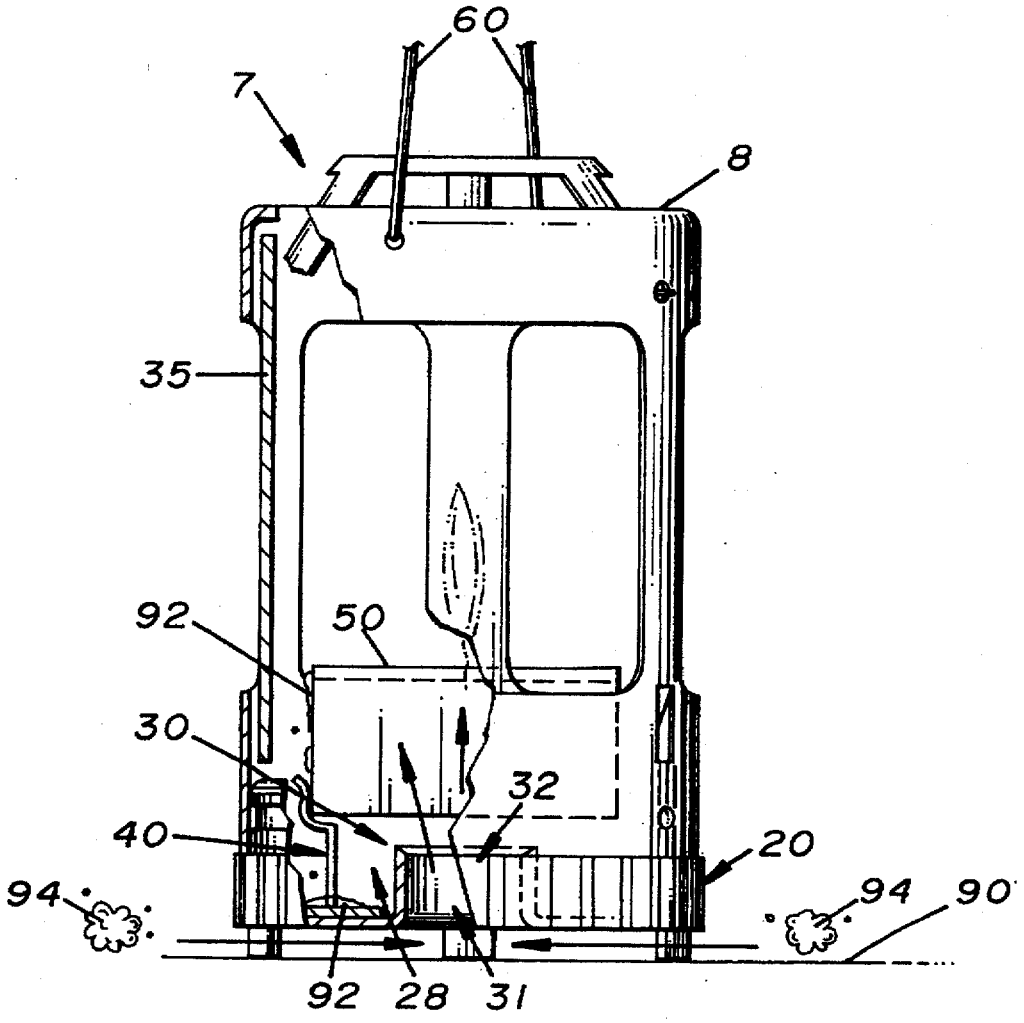
FIG. 5. is a side elevational view, partially in section, of the candle lantern.

As shown in FIG. 5, the cool combustion air 94 travels along the support surface 90 and enters the candle lantern 7 via the air delivery tube 30. As the combustion air 94 enters the lower base 20, it cools the outer surface of the tub candle 50, the inner surface of the lower base 20, and the candle holding assembly 40. This feature keeps the temperature inside the candle lantern 7 relatively low and prevents a "flash" condition from occurring. If the melted wax 92 in the tub candle 50 spills out, it drips into the collection cavity 28. Since the top opening 32 of the air deliver tube 30 is elevated above the collection cavity 28, the flow of combustion air 94 into the lower base 20 is not blocked. Also, the spilled wax 92 has no means for exiting the lower base 20 thereby preventing damage to adjacent surfaces.

In the embodiment shown, the candle lantern 7 is designed to be used with tub candles which measure approximately 1½ inches in diameter and ¾ inches in height. The upper cover 8 which is made of metal measures approximately 2¼ inches in diameter and 3¼ inches in height. The lower base 20 is made of durable plastic material and measures approximately 2¼ inches in diameter and ¾ inches in height. The feet 29 have sufficient length to elevate the lower base 20 approximately 3/16 above a support surface 90. In the embodiment shown, the air delivery tube 30 is approximately ½ inch in diameter and extends into the collection cavity 28 approximately ½ inch.

In compliance with the statute, the invention, described herein, has been described in language more or less specific as to structural features. It should be understood, however, the invention is not limited to the specific features shown, since the means and construction shown comprised only the preferred embodiments for putting the invention into effect. The invention is, therefore, claimed in any of its forms or modifications within the legitimate and valid scope of the amended claims, appropriately interpreted in accordance with the doctrine of equivalents.

I claim:

1. A portable candle lantern, comprising:

a) an upper cover, said upper cover having a lower opening and plurality of viewing openings formed therein;

b) a lower base, said lower base having a plurality of feet for supporting said lower base in an elevated position on a support surface, said lower base having a longitudinal axis:

c) an air delivery tube formed inside said lower base capable of delivering outside air inside to said lower base and against said candle support assembly and said tub candle, said air delivery tube having a central passageway;

d) a candle support assembly disposed inside said lower base for supporting a tub candle in a longitudinally aligned, elevated position inside said lower base, said candle support means includes a plate with a plurality of legs extending therefrom capable of supporting a tub candle in a centrally aligned, elevated position over said central passageway on said air delivery tube;

e) a tub candle attached to said candle support assembly; and, f) a cover attachment means enabling said upper cover to be selectively attached to said lower base.

2. A candle lantern as recited in claim 1 wherein said air delivery tube is longitudinally aligned inside said lower base.

3. A candle lantern as recited in claim 1, wherein said cover attachment means includes at least one lip structure formed on said lower base and at least one detent structure formed on said lip cover, said lip structure and detent being aligned on said lower base and said upper cover so that when said lower base is placed over said lower opening on said upper cover and rotated, said detent structure engages said lip structure to selectively attach said lower base to said upper cover.

4. A candle lantern, as recited in claim 1, wherein said upper cover further includes an outer lens disposed therein.

5. A candle lantern as recited in claim 4, further including a heat shield attached to said upper cover.

6. A candle lantern as recited in claim 5, further including a handle attached to said upper cover.

7. A portable candle lantern, comprising:

a) an upper cover, said upper cover including a cylindrical outer frame, a heat shield and an outer lens, said upper cover also including a lower opening;

b) a lower base, said lower base having a plurality of feet for elevating said lower base on a support surface, said lower base having a collection cavity formed therein;

c) a candle support assembly disposed inside said lower base for supporting a tub candle in an elevated, longitudinally aligned position inside said candle lantern, said candle support assembly includes a plate with a plurality of legs extending therefrom capable if supporting said tub candle;

d) a tub candle attached to said candle support assembly;

e) an air delivery tube formed inside said lower base capable of delivering air inside said lower base and against said candle support means and said tub candle, said air delivery tube being longitudinally aligned on said lower base; and, f) a cover attachment means enabling said upper cover to be selectively attached to said lower base, said cover attachment means includes at least one lip structure formed on said lower base and at least one detent structure formed on said upper cover, said lip structure and detent structure being aligned on said lower base and said upper cover, respectively, so that when said lower base is placed into said lower opening on said upper cover and rotated, said detent structure engages said lip structure to selectively attach said lower base to said upper cover.

8. A candle lantern as recited in claim 7, further including a handle attached to said upper cover.

* * * * *